US009057512B2

(12) United States Patent
En et al.

(10) Patent No.: US 9,057,512 B2
(45) Date of Patent: Jun. 16, 2015

(54) VEHICLE LIGHTING UNIT

(71) Applicant: Stanley Electric Co., Ltd., Tokyo (JP)

(72) Inventors: Chiho En, Tokyo (JP); Toshimichi Anzai, Tokyo (JP); Yoshiaki Nakazato, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 197 days.

(21) Appl. No.: 13/749,032

(22) Filed: Jan. 24, 2013

(65) Prior Publication Data

US 2013/0188376 A1 Jul. 25, 2013

(30) Foreign Application Priority Data

Jan. 24, 2012 (JP) ..... 2012-012145

(51) Int. Cl.

| | |
|---|---|
| ***F21V 11/00*** | (2006.01) |
| ***F21V 19/02*** | (2006.01) |
| ***F21V 21/34*** | (2006.01) |
| ***F21S 8/10*** | (2006.01) |

(52) U.S. Cl.

CPC ..... *F21V 21/34* (2013.01); *F21S 48/1109* (2013.01); *F21S 48/1159* (2013.01); *F21S 48/1208* (2013.01); *F21S 48/1305* (2013.01); *F21S 48/321* (2013.01)

(58) Field of Classification Search

CPC ..... F21S 48/115; F21S 48/1159
USPC ..... 362/507, 460, 523, 538, 285, 531, 532, 362/508

See application file for complete search history.

(56) References Cited

U.S. PATENT DOCUMENTS

2007/0171662 A1* 7/2007 Tokida ..... 362/459
2009/0003400 A1* 1/2009 Nagahama et al. ..... 372/50.23

FOREIGN PATENT DOCUMENTS

JP 2010-165834 A 7/2010

* cited by examiner

*Primary Examiner* — Anh Mai
*Assistant Examiner* — Zachary J Snyder
(74) *Attorney, Agent, or Firm* — Kenealy Vaidya LLP

(57) ABSTRACT

A vehicle lighting unit can form a structure or mechanism for positioning and installing a light emitting device in a vehicle lighting unit main body.

16 Claims, 6 Drawing Sheets

VEHICLE LIGHTING UNIT

This application claims the priority benefit under 35 U.S.C. §119 of Japanese Patent Application No. 2012-012145 filed on Jan. 24, 2012, which is hereby incorporated in its entirety by reference.

TECHNICAL FIELD

The presently disclosed subject matter relates to a vehicle lighting unit, and in particular, to a vehicle lighting unit having a structure for positioning and installing a light emitting device in a vehicle lighting unit main body.

BACKGROUND ART

Conventionally,—light emitting devices have been proposed, which include an excitation light source, a wavelength conversion member disposed at a position spaced away from the excitation light source, a condensing lens disposed between the excitation light source and the wavelength conversion member, and a holder configured to hold the excitation light source, the wavelength conversion member, and the condensing lens. (See, for example, Japanese Patent Application Laid-Open No. 2010-165834.)

FIG. 1 is a vertical cross-sectional view of a light emitting device 200 described in Japanese Patent Application Laid-Open No. 2010-165834.

As shown in FIG. 1, the described light emitting device 200 can include an excitation light source 210, a condensing lens 220, and a wavelength conversion member 230. The device 200 can collect excitation light beams from the excitation light source 210 by means of the condensing lens 220 to irradiate the wavelength conversion member 230, which is disposed at a position spaced apart from the excitation light source 210, with the collected excitation light beams. The wavelength conversion member 230 irradiated with the excitation light beams can emit light resulting from its excitation by the excitation light beams. The resulting wavelength converted light beams and the excitation light beams that are not used for the excitation are mixed and exit from the wavelength conversion member 230.

Japanese Patent Application Laid-Open No. 2010-165834 only discloses the light emitting device 200 structure, but does not propose a structure or mechanism for positioning and installing the light emitting device in a vehicle lighting unit main body.

SUMMARY

The presently disclosed subject matter was devised in view of these and other problems and features and in view of the conventional art. According to an aspect of the presently disclosed subject matter, a vehicle lighting unit can include a structure for positioning and installing a light emitting device in a vehicle lighting unit main body.

According to another aspect of the presently disclosed subject matter, a vehicle lighting unit can include a light emitting device disposed below a predetermined light source position and having an excitation light source, a wavelength conversion member disposed at a position spaced away from and above the excitation light source, a condensing lens disposed between the excitation light source and the wavelength conversion member, and a holder configured to hold the excitation light source, the wavelength conversion member, and the condensing lens; a supporting member configured to support the light emitting device so as to allow the light emitting device to move horizontally; a first fixing member configured to fix the light emitting device and the supporting member together in a state where the wavelength conversion member is disposed on a vertical axis passing through the predetermined light source position; a vertical guiding member which the supporting member is in surface contact with and has a vertical guiding face to allow the supporting member to vertically slide in a state where the supporting member is in surface contact with the vertical guiding member; a stopper which the light emitting device supported by the supporting member that vertically slides is brought into contact with to restrict the vertically sliding supporting member, thereby positioning the wavelength conversion member in the predetermined light source position; a second fixing member configured to fix the supporting member and the vertical guiding member together in a state where the light emitting device is in contact with the stopper and the supporting member is in surface contact with the vertical guiding face; and a vehicle lighting unit main body configured to project light emitted from the light emitting device disposed below the predetermined light source position in a forward direction.

The vehicle lighting unit having the above configuration can include a structure or mechanism for positioning and installing the light emitting device in a vehicle lighting unit main body.

Specifically, the positional relationship between the excitation light source and the wavelength conversion member of each light emitting device may be varied due to the variation in installing the excitation light source, the condensing lens, and the like with respect to the holder during manufacturing. Even with such a circumstance, the vehicle lighting unit having the above configuration can accurately position the wavelength conversion member to the predetermined light source position and fix the same by causing the light emitting device to move horizontally (horizontal positioning) and causing the supporting member to vertically slide until the light emitting device is in contact with the stopper (vertical positioning).

The vehicle lighting unit with the above configuration can further include a heat dissipation member fixed to the supporting member and configured to dissipate heat generated from the excitation light source, and the vehicle lighting unit main body can include a holding member having a through hole formed therein for allowing the holder to be fit to the through hole at its upper end.

In the vehicle lighting unit with the above configuration, the upper end of the holder can be fit to the through hole formed in the holding member constituting the vehicle lighting unit main body. Furthermore, the supporting member and the vertical guiding member can be fixed together while the supporting member is in surface contact with the vertical guiding member. Therefore, even if a heavy heat dissipation member is fixed to the supporting member, the heavy heat dissipation member can be firmly fixed.

In the vehicle lighting unit with the above configuration, the excitation light source can be a semiconductor laser light source.

The vehicle lighting unit with the above configuration can utilize a semiconductor laser light source as the excitation light source, thereby achieving a higher luminance light source than those using an LED light source.

Thus, the presently disclosed subject matter can provide a vehicle lighting unit with the structure for positioning and installing the light emitting device in a vehicle lighting unit main body.

In accordance with yet another aspect of the disclosed subject matter, a vehicle lighting unit can include a light emitting device having an excitation light source, a wavelength conversion member spaced away from the excitation light source, a condensing lens disposed between excitation light source and the wavelength conversion member and at least one holder configured to hold the excitation light source, the wavelength conversion member and the condensing lens. A positioning mechanism can be provided for positioning the light emitting device, wherein the positioning mechanism can include a supporting member configured to support the light emitting device, the supporting member including a base portion and a supporting main body. The positioning mechanism can further include at least one vertical guiding member formed adjacent to the supporting member. A main body can include at least one reflector surface and an aperture into which the light emitting device is configured to be inserted. The positioning mechanism can be configured such that the light emitting device is slidable in a vertical direction between a first position in which the light emitting device is inserted in the aperture of the main body and a second position in which the light emitting device is spaced from the aperture of the main body.

In accordance with another aspect of the disclosed subject matter, a vehicle lighting unit can include a light emitting device disposed below a predetermined light source position and having an excitation light source, a wavelength conversion member above the excitation light source, a condensing lens disposed between the excitation light source and the wavelength conversion member, and a holder configured to hold the excitation light source, the wavelength conversion member, and the condensing lens; a supporting member configured to support the light emitting device and allow the light emitting device to move horizontally; a first fixing member configured to fix the light emitting device and the supporting member together while the wavelength conversion member is disposed on a vertical axis passing through the predetermined light source position; a vertical guiding member which has a vertical guiding face to allow the supporting member to vertically slide while the supporting member is in surface contact with the vertical guiding member; a stopper which the light emitting device is brought into contact with to restrict the vertically sliding supporting member, thereby positioning the wavelength conversion member in the predetermined light source position; a second fixing member configured to fix the supporting member and the vertical guiding member together while the light emitting device is in contact with the stopper and the supporting member is in surface contact with the vertical guiding face; and a vehicle lighting unit main body configured to project light emitted from the light emitting device in a forward direction.

BRIEF DESCRIPTION OF DRAWINGS

These and other characteristics, features, and advantages of the presently disclosed subject matter will become clear from the following description with reference to the accompanying drawings, wherein.

DESCRIPTION OF EXEMPLARY EMBODIMENTS

A description will now be made below to vehicle lighting units of the presently disclosed subject matter with reference to the accompanying drawings in accordance with exemplary embodiments.

Further, the directions of up (high), down (low), right, left, front, and rear (back), and the like are defined on the basis of the actual posture of a lighting unit or a headlamp installed on a vehicle body, unless otherwise specified.

A vehicle lighting unit 100 can include a structure for positioning and installing a light emitting device 10 in a vehicle lighting unit main body 24, and will be described with reference to the drawings as an exemplary embodiment of the presently disclosed subject matter.

Figure 1:
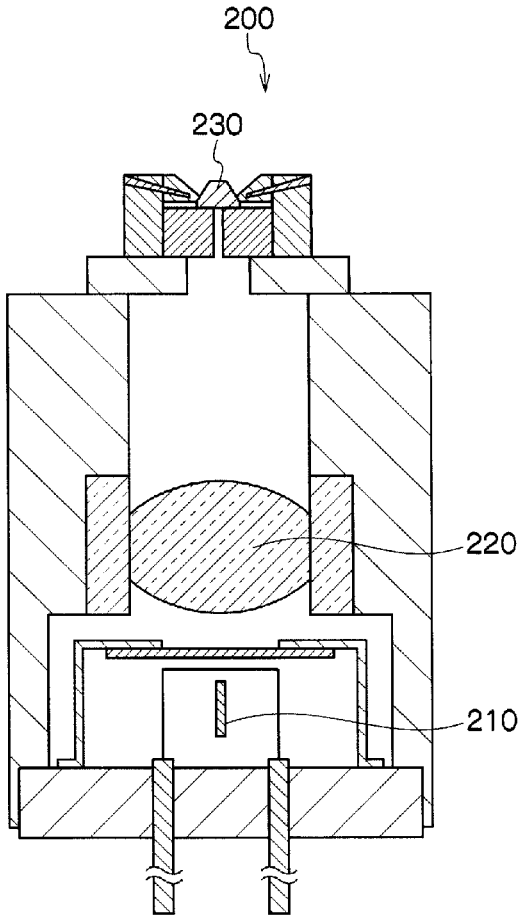
Fig. 1 Conventional Art
FIG. 1 is a vertical cross-sectional view showing a conventional light emitting device.
Figure 2:
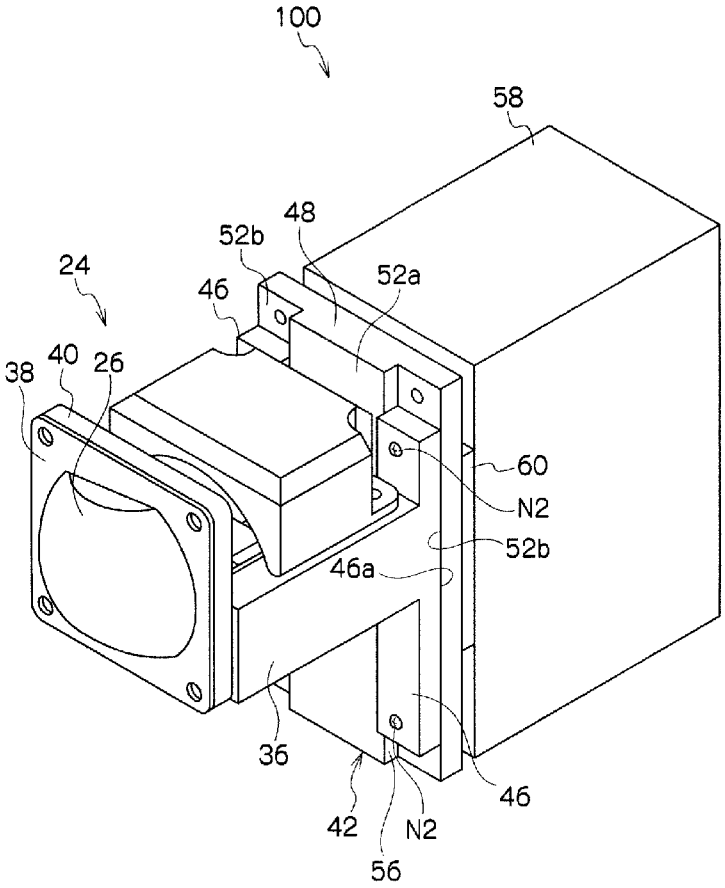
FIG. 2 is a perspective view showing a vehicle lighting unit made in accordance with principles of the presently discloses subject matter.
Figure 3:
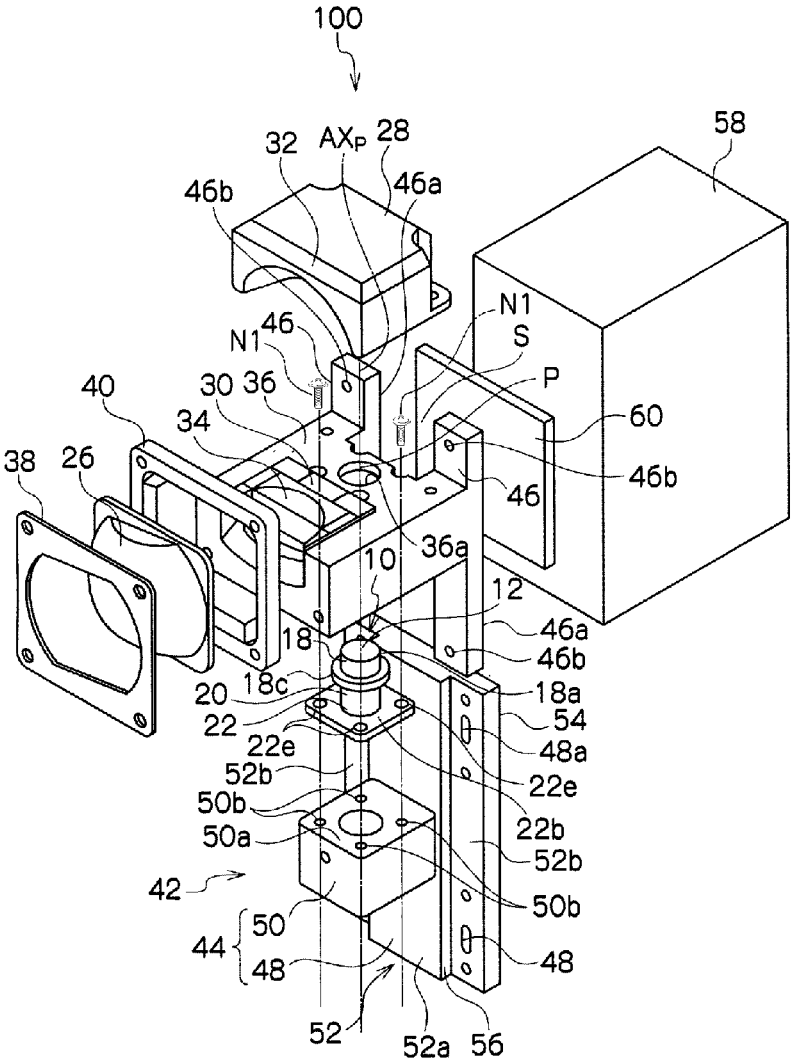
FIG. 3 is an exploded perspective view showing the vehicle lighting unit of FIG. 2.
Figure 4:
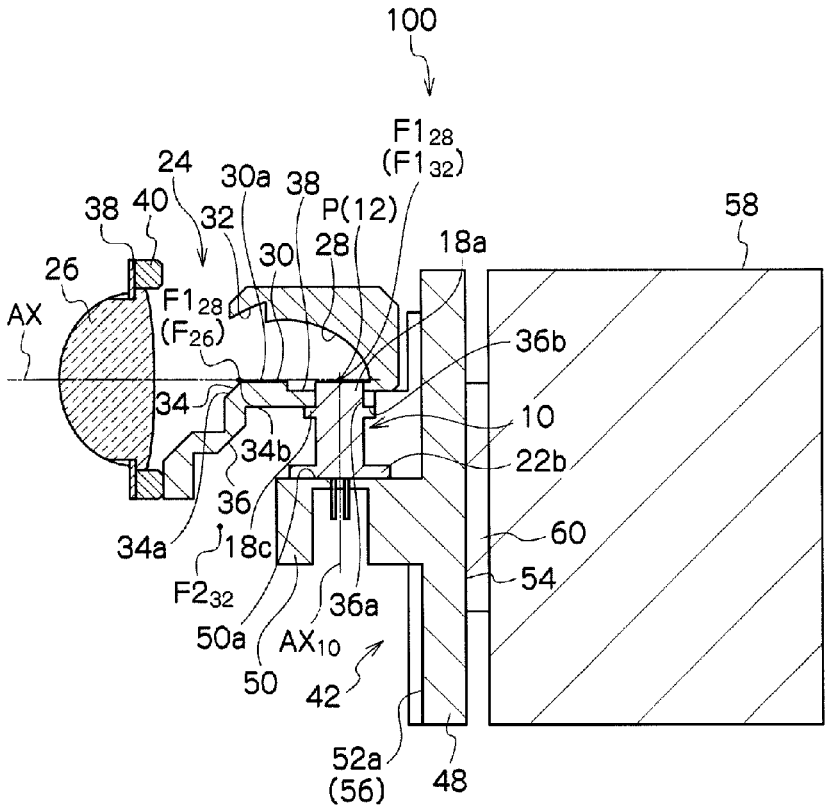
FIG. 4 is a vertical cross-sectional view showing the vehicle lighting unit of FIG. 2 along a vertical plane including its optical axis.

FIG. 2 is a perspective view showing the vehicle lighting unit made in accordance with the principles of the presently discloses subject matter, FIG. 3 is an exploded perspective view showing the vehicle lighting unit of FIG. 2, and FIG. 4 is a vertical cross-sectional view showing the vehicle lighting unit of FIG. 2 along a vertical plane including its optical axis.

The vehicle lighting unit 100 according to an exemplary embodiment can be a projector type lighting unit for use in the formation of a low-beam light distribution pattern. As shown in FIGS. 2 and 3, the vehicle lighting unit 100 can include a light emitting device 10, a vehicle lighting unit main body 24, a positioning mechanism 42 configured to position and install the light emitting device 10 in the vehicle lighting unit main body 24, a heat dissipation member 58 configured to dissipate heat generated by the light emitting device 10, and the like.

A description will now be given of the light emitting device 10.

Figure 5:
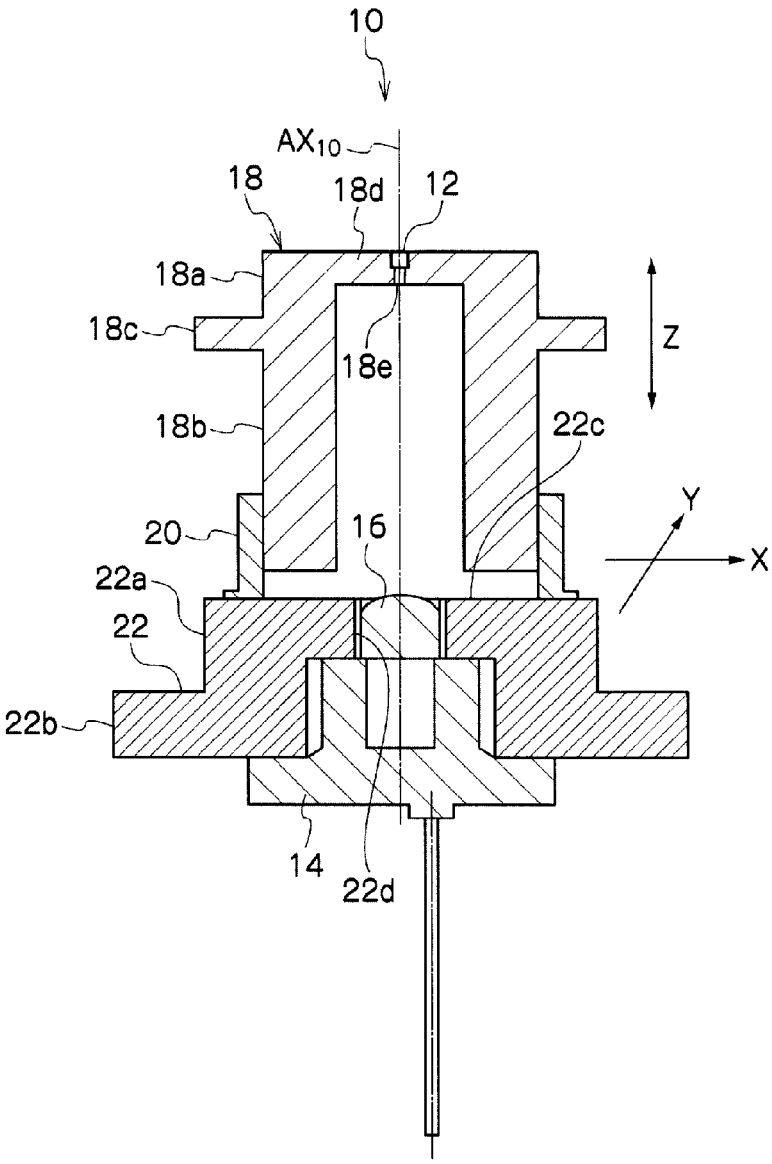
FIG. 5 is a vertical cross-sectional view showing a light emitting device along a vertical plane including its optical axis (center axis)

FIG. 5 is a vertical cross-sectional view showing the light emitting device 10 taken along a vertical plane including its optical axis $AX_{10}$ (center axis).

As shown in FIG. 5, the light emitting device 10 can include an excitation light source 14, a wavelength conversion member 12 disposed at a position spaced away from and above the excitation light source 14, a condensing lens 16 disposed between the excitation light source 14 and the wavelength conversion member 12, and holders configured to hold the excitation light source 14, the wavelength conversion member 12, and the condensing lens 16 and to include a first holder 18, a second holder 20, and a third holder 22.

The wavelength conversion member 12 can be excited by excitation light beams (can absorb the same) and emit light with specific wavelengths by wavelength conversion. The wavelength conversion member 12 can be formed of, for example, YAG phosphor shaped in a circular plate with a thickness of about 80 μm and a diameter of about 0.6 mm.

The excitation light source 14 can generate excitation light beams and preferably be a semiconductor light emitting element such as a light emitting diode (LED), a laser diode (LD) or the like. Particularly, in terms of the light utilization efficiency, a laser diode is preferably used. In the present exemplary embodiment, an LD with an emission wavelength of about 450 nm can be used as an excitation light source. Of course, the wavelength of the light beam emitted from the excitation light source 14 can fall within a near ultraviolet range, and for example, the excitation light source 14 can be an LD with a wavelength of 405 nm. In this case, a phosphor obtained by mixing RGB emission phosphors can be used as the wavelength conversion member 12.

The condensing lens 16 can collect the excitation light beams emitted from the excitation light source 14 and irradiate the wavelength conversion member 12, which is disposed at a position spaced apart from and above the excitation light source 14, with the collected excitation light beams. The wavelength conversion member 12 irradiated with the excitation light beams can emit light resulting from its excitation by the excitation light beams. The resulting wavelength converted light beams and the excitation light beams that are not used for the excitation are mixed and exit from the wavelength conversion member 12 as pseudo white light.

The positional relationships between the wavelength conversion member 12, the excitation light source 14, and the condensing lens 16 can be adjusted by the first to third holders 18, 20, and 22 so that the excitation light beams emitted from the excitation light source 14 and collected by the condensing lens 16 can accurately impinge on the wavelength conversion member 12. A description will now be given of the adjustment method.

The first holder 18 can be a member configured to hold the wavelength conversion member 12 and, for example, be a metal cylinder made of aluminum or the like. The first holder 18 can include an upper cylinder portion 18*a*, a lower cylinder portion 18*b*, a flange portion 18*c* disposed between them, and a circular plate portion 18*d* extending from the upper opening of the upper cylinder portion 18*a*.

Figure 6:
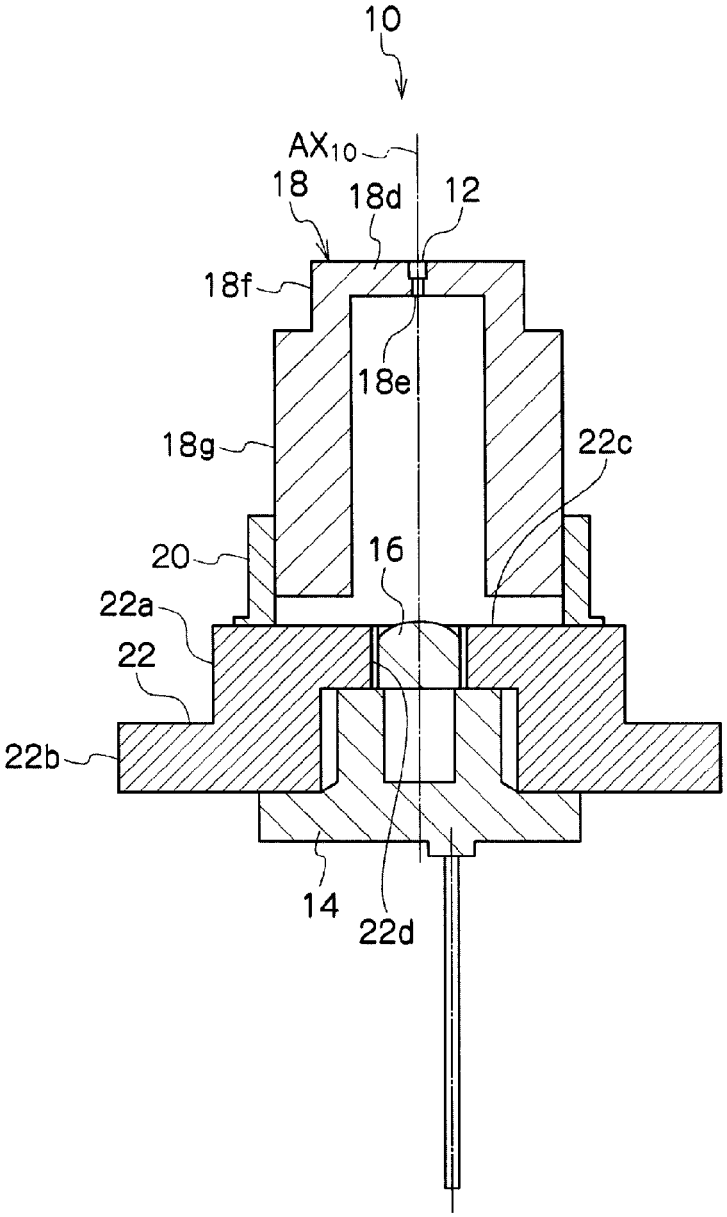
FIG. 6 is a vertical cross-sectional view showing a modified example of the light emitting device of FIG. 5, along a vertical plane including its optical axis (center axis).

As a modified example, the first holder 18 may include an upper small-diameter cylinder portion 18*f* and a lower large-diameter cylinder portion 18*g* as shown in FIG. 6.

A through hole 18*e* penetrating in the thickness direction can be formed at the center of the plate portion 18*d*. The excitation light beams emitted from the excitation light source 14 and collected by the condensing lens 16 can pass through the through hole 18*e*, and the wavelength conversion member 12 can be disposed inside the through hole 18*e*.

The second holder 20 can be a member configured to hold the first holder 18 and, for example, be a metal cylinder made of aluminum or the like. The lower cylinder portion 18*b* of the first holder 18 can be fit to the upper end of the second holder 20.

A description will next be given of how the first holder 18 is fixed to the second holder 20.

First, the first holder 18 is moved in the optical axis $AX_{10}$ direction (in the Z direction in FIG. 5) with respect to the second holder 20 so that the excitation light beams emitted from the excitation light source 14 and collected by the condensing lens 16 are not out of alignment in the optical axis $AX_{10}$ direction (in the Z direction in FIG. 5) and thus the wavelength conversion member 12 can be accurately positioned at the proper position where the excitation light beams are accurately irradiated. Then, the first and second holders 18 and 20 can be securely fixed by YAG welding, adhesive bonding, or other known methods. Note that the adjustment of the preferable position where the excitation light beams are accurately irradiated can be determined by actually turning on the excitation light source 14 with a given output to irradiate the wavelength conversion member 12 while moving the first holder 18 with respect to the second holder 20 in the optical axis $AX_{10}$ direction.

The third holder 22 can be a member configured to hold the second holder 20, the excitation light source 14, and the condensing lens 16, and, for example, be a metal cylinder made of aluminum or the like. The third holder 22 can include a cylinder portion 22*a*, a flange portion 22*b* disposed at the lower edge of the cylinder portion 22*a*, and a circular plate portion 22*c* extending from the upper opening of the cylinder portion 22*a*. A through hole 22*d* penetrating in the thickness direction can be formed at the center of the plate portion 22*c*. The excitation light beams emitted from the excitation light source 14 can pass through the through hole 22*d*, and the condensing lens 16 can be disposed inside the through hole 22*d*.

The excitation light source 14 can be fixed to the lower surface of the third holder 22 in the state where the light emission surface of the excitation light source 14 faces toward the lower opening end of the through hole 22*d* so that the excitation light beams can pass through the through hole 22*d*.

A description will next be given of how the second holder 20 is fixed to the third holder 22.

First, the second holder 20 is moved in the X and Y directions (note that the Y direction is perpendicular to the paper surface of the drawing in FIG. 5) with respect to the third holder 22 in the state where the lower opening end of the second holder 20 is in contact with the upper surface of the plate portion 22*c* of the third holder 22 so that the excitation light beams emitted from the excitation light source 14 and collected by the condensing lens 16 are not out of alignment in the X and Y directions as shown in FIG. 5 and thus the wavelength conversion member 12 can be accurately positioned at the proper position where the excitation light beams are accurately irradiated. Then, the second and third holders 20 and 22 can be securely fixed by YAG welding, adhesive bonding, or other known methods.

In the light emitting device 10 with the above configuration, the wavelength conversion member 12 can be accurately irradiated with excitation light beams emitted from the excitation light source 14 and collected by the condensing lens 16 when aligned in the X and Y directions as well as in the Z direction, resulting in achievement of the maximum output from the wavelength conversion member 12.

In the light emitting device 10 with the above configuration, however, individual light emitting devices 10 may vary in terms of the moving amount of the first holder 18 in the Z direction with respect to the second holder 20 (adjustment amount in the Z direction) as well as the moving amounts of the second holder 20 in the X and Y directions with respect to the third holder 22 (adjustment amounts in the X and Y directions). As a result, the positional relationships between the wavelength conversion member 12 and the excitation light source 14 of the individual light emitting devices 10 (the respective positional relationships in the X and Y directions and the Z direction) may vary.

A description will next be given of the vehicle lighting unit main body 24 in which the light emitting device 10 with the above configuration is to be installed.

As shown in FIGS. 2 to 4, the vehicle lighting unit main body 24 can be configured to be a projector type lighting unit and to project light emitted from the light emitting device 10 at a predetermined light source position P, i.e., from the wavelength conversion member 12 positioned at the light source position P in a manner described later, in the forward direction so that a low-beam light distribution pattern is formed on a virtual vertical screen assumed to be disposed about 25 m away from and in front of a vehicle body in which the vehicle lighting unit is to be installed. The vehicle lighting unit main body 24 can include a projector lens 26, a main reflector 28, a shade 30, a first auxiliary reflector 32, a second auxiliary reflector 34, a holding member 36, and the like. It should be noted that the predetermined light source position P can be set to be behind the rear focal point $F_{26}$ of the projector lens 26 and on or near the optical axis AX.

The projector lens 26 can be held between a presser ring 38 and a lens holder 40 screwed to the holding member 36 so as to be disposed on the optical axis AX extending in the vehicle front-to-rear direction. The projector lens 26 can include a convex front surface and a planoconvex aspheric rear lens surface.

The main reflector 28 can be formed of a revolved ellipsoid or similar free curved surface having a first focal point $F1_{28}$ disposed at or near the predetermined light source position P and a second focal point $F2_{28}$ disposed at or near the rear focal point $F_{26}$ of the projector lens 26. The main reflector 28 can extend from one side of the predetermined light source position P (from the vehicle rear side in FIGS. 2 to 4) toward the projector lens 26 and cover the predetermined light source position P from above. The main reflector 28 can be designed such that relatively high luminous intensity light beams emitted substantially upward from the predetermined light source position P in narrow angle directions with respect to the optical axis $AX_{10}$ of the light emitting device 10 (for example, light within about the half value angles) can be incident on the main reflector 28.

The shade 30 can have a mirror surface 30*a* extending from the position of the rear-side focal point $F_{26}$ of the projector lens 26 toward the predetermined light source position P. The front edge of the shade 30 can be curved along the rear focal point of the projector lens 26. Part of the light can be incident on the mirror surface 30*a*, reflected upward by the same to enter the projector lens 26, and refracted by the projector lens 26 to be directed to a road surface. In this manner, the part of the light being incident on the mirror surface 30*a* can be overlaid on the light distribution pattern below a cut-off line thereof. In this manner, the cut-off line can be formed at the upper edge of the low-beam light distribution pattern.

The first auxiliary reflector 32 can be formed of a revolved ellipsoid or similar free curved surface having a first focal point $F1_{32}$ disposed at or near the predetermined light source position P and a second focal point $F2_{32}$ disposed below the second auxiliary reflector 34.

The first auxiliary reflector 32 can extend from the tip end of the main reflector 28 toward the projector lens 26 and be disposed between the projector lens 26 and the main reflector 28 so that the light beams emitted upward from the predetermined light source position P can be incident thereon. Note that the first auxiliary reflector 32 can have a length that does not block the light beams reflected by the main reflector 28 and directed to the projector lens 26.

The main reflector 28 and the first auxiliary reflector 32 can be formed as a single part and be obtained by integrally molding a reflector base using a metal mold and subjecting the reflector base to mirror finishing such as by aluminum deposition. This can reduce the number of required parts, simplify the assembly steps for the respective reflectors 28 and 32, and reduce the assembly errors for the respective reflectors 28 and 32 when compared with the case where the respective reflectors 28 and 32 are formed as separate parts. However, of course, the main reflector 28 and the first auxiliary reflector 32 can be formed as separate parts in accordance with the required specification and the like.

The second auxiliary reflector 34 can be disposed between the projector lens 26 and the rear focal point $F_{26}$ of the projector lens 26 so that the light beams reflected by the first auxiliary reflector 32 and converged at the second focal point $F2_{32}$ of the first auxiliary reflector 32 can be incident thereon.

The second auxiliary reflector 34 can be a planar mirror and be inclined with respect to a horizontal plane so as to have a lower front end 34*a* and an upper rear end 34*b*.

In the vehicle lighting unit main body 24 with the above configuration, part of the light beams emitted from the predetermined light source position P can be incident on the main reflector 28 and reflected by the same to be converged at or near the rear focal point $F_{26}$ of the projector lens 26, and then pass through the projector lens 26 to be projected forward. Therefore, the low-beam light distribution pattern including an upper edge as a cut-off line defined by the shade 30 can be formed on the virtual vertical screen.

Furthermore, part of the light beams emitted from the predetermined light source position P can be incident on the first auxiliary reflector 32 and reflected by the same and then by the second auxiliary reflector 34, and then pass through the projector lens 26 to be projected forward in a slightly upward direction with respect to a horizontal plane, for example, in a direction ranging within 2 to 4 degrees upward. This can form an overhead sign light distribution pattern in an overhead sign region on the virtual vertical screen.

A description will now be given of the positioning mechanism 42 used for positioning and installing the light emitting device 10 in the vehicle lighting unit main body 24.

The positioning mechanism 42 can include a supporting member 44, a pair of vertical guiding members 46, and the like.

The supporting member 44 can be configured to support the light emitting device 10 while the light emitting device 10 can move along a horizontal plane. The supporting member 44 can include a base portion 48, and a supporting main body 50. The base portion 48 and the supporting main body 50 can be integrally formed using a metal such as aluminum in order to be allowed to function as a heat transfer member (heat dissipation path) through which heat generated in the light emitting device 10 can transmit.

The base portion 48 can be a rectangular plate member and have a front face 52 directed forward and a rear face 54 opposite to the front face 52 and directed rearward.

The front face 52 can include three divided areas including a center face 52*a* at the center thereof and side faces 52*b* on either side of the center face 52*a*.

The center face 52*a* can be a rectangular face extending from the lower edge to the upper edge of the front face 52, and be projected forward more than the side faces 52*b* on either side thereof. Therefore, the center face 52*a* can constitute a center step portion 56 to be fit to the space S between the pair of vertical guiding members 46 (vertical guiding faces).

The side faces 52*b* can be configured to be in surface contact with the vertical guiding faces 46*a* extending vertically, and arranged on either side of the center step portion 56.

A heat sink or the like heat dissipation member 58 can be fixed by screwing to the rear face 54. A Peltier element 60 can be arranged between the rear face 54 and the heat dissipation member 58. The heat generated at the light emitting device 10 can pass through the supporting main body 50, the base portion 48, the Peltier element 60, and the heat dissipation member 58 (radiation fins of the heat sink, for example), where the heat is dissipated to surrounding air.

The supporting main body 50 can be configured to support the light emitting device 10 while the light emitting device 10 can move along the horizontal plane, and project forward from the center face 52*a* of the base portion 48.

The supporting main body 50 can have a top face 50*a* being a horizontal plane while the center step portion 56 is fit to the space S between the pair of vertical guiding members 46 and the both side faces 52*b* are in surface contact with the vertical guiding faces 46*a* of the pair of vertical guiding members 46. (See FIG. 4.)

The light emitting device 10 can be mounted on the top face 50*a* of the supporting main body 50 in a state where the lower end face of the third holder 22 (the face orthogonal to the optical axis $AX_{10}$) is in surface contact with the top face 50*a* of the supporting main body 50.

Then, the light emitting device 10 can be attached to the supporting main body 50 with screws N1 inserted to through holes 22*e* formed in the flange portion 22*b* of the third holder 22 and screwed to screw holes 50*b* formed in the supporting main body 50, for example, at four positions. (The drawing includes two screws N1 as representative examples.)

The through holes 22*e* can have a larger diameter than the inserted screw N1 has. Therefore, when the screws N1 are loosened from the screw holes 50*b* of the supporting main body 50, the light emitting device 10 can move along the top face 50*a* (or horizontal plane) of the supporting main body 50 within the range of the through hole 22*e*.

The pair of vertical guiding members 46 can be configured to support the supporting member 44, and made of a metal such as aluminum so as to vertically extend. The guiding members 46 can be integrally formed with the metal holding member 36, for example, formed of aluminum. The pair of vertical guiding members 46 can be arranged on either side of the optical axis AX and symmetric with respect to the optical axis $AX_{10}$. The space S to which the center step portion 56 of the base portion 48 can be fit can be formed between the pair of vertical guiding members 46.

The pair of vertical guiding members 46 can include the vertically extending vertical guiding faces 46*a*.

The vertical guiding faces 46*a* can be configured to be in surface contact with the supporting member 44 (or the both side faces 52*b*) and face rearward. Along the vertical guiding faces 46*a* (vertical faces orthogonal to the optical axis AX) the supporting member 44 can slide vertically in a state where the supporting member 44 is still in surface contact therewith.

A description will now be given of the operation example of the light emitting device 10 after it is positioned with respect to, and attached to, the vehicle lighting unit main body 24.

First, the center step portion 56 of the supporting member 44 is fit to the space S between the pair of vertical guiding members 46 while the both side faces 52*b* are brought in surface contact with the respective vertical guiding faces 46*a* of the pair of vertical guiding member 46. With this operation, the top face 50*a* of the supporting main body 50 can become a horizontal plane (horizontal face) while the light emitting device 10 can be arranged below the predetermined light source position P.

Next, the screws N1 screwed to the screw holes 50*b* in the supporting main body 50 are loosened, so that the light emitting device 10 is caused to move along the top face 50*a* (horizontal plane) of the supporting main body 50. In this manner, the wavelength conversion member 12 can be positioned on the vertical axis $AX_P$ that passes through the predetermined light source position P (horizontal positioning). While the light emitting device 10 is at that position, the screws N1 are tightened to the screw holes 50*b* of the supporting main body 50 (exemplary of the first fixing member as defined in the presently disclosed subject matter), to thereby secure the light emitting device 10 to the supporting main body 50.

This can solve the variation in the positional relationship between the wavelength conversion member 12 and the excitation light source 14 due to the variation in installing the excitation light source 14, the condensing lens 16, and the like with respect to the third holder 22 (i.e., the variation in the X and Y directions or within the horizontal plane).

Then, the supporting member 44 is caused to slide vertically (upward) along the vertical guiding faces 46*a* while the center step portion 56 of the supporting member 44 is still fit to the space S between the pair of vertical guiding members 46 and the both side faces 52*b* are in surface contact with the vertical guiding faces 46*a* of the pair of vertical guiding members 46.

When the supporting member 44 is caused to slide vertically along the vertical guiding faces 46*a*, the upper cylinder portion 18*a* of the first holder 18 of the light emitting device 10, which has been fixed to the supporting member 44, is allowed to fit to the through hole 36*a* formed in the holding member 36. When the supporting member 44 is caused to vertically slide further along the vertical guiding faces 46*a*, the flange portion 18*c* of the first holder 18 of the light emitting device 10 can abut the lower face 36*b* of the holding member 36 (exemplary of the stopper as defined in the presently disclosed subject matter). In this manner, the vertical movement of the supporting member 44 can be restricted, meaning that the wavelength conversion member 12 can be positioned at the predetermined light source position P (vertical positioning).

Then, screws N2 inserted into through holes 48*a* formed in the supporting member 44 (base part 48) and screwed to screw holes 46*b* formed in the pair of vertical guiding members 46, for example, at four positions, are tightened (exemplary of the second fixing member as defined in the presently disclosed subject matter), thereby securely fixing the supporting member 44 and the vertical guiding member 46.

This can solve the variation in the positional relationship between the wavelength conversion member 12 and the excitation light source 14 due to the variation in installing the excitation light source 14, the condensing lens 16, and the like with respect to the third holder 22 (i.e., the variation in the Z direction or in the vertical direction).

As described above, the vehicle lighting unit 100 can be configured to include the structure for positioning the light emitting device 10 with respect to the vehicle lighting unit main body 24 and attaching it to the main body 24.

In the above-described exemplary embodiment, even when the positional relationship between the wavelength conversion member 12 and the excitation light source 14 of each individual light emitting device 10 may be varied due to the variation in installing the excitation light source 14, the condensing lens 16, and the like with respect to the third holder 22 during its manufacturing, the vehicle lighting unit 100 having the above configuration can accurately position the wavelength conversion member 12 to the predetermined light source position P and fix the same by causing the light emitting device 10 to move along the horizontal plane (horizontal positioning) and causing the supporting member 44 to vertically slide until the light emitting device 10 is in contact with the holding member 36 (vertical positioning).

In the present exemplary embodiment, the upper end of the first holder 18 (the upper cylinder portion 18*a* of the first holder 18) can be fit to the through hole 36*a* formed in the holding member 36 constituting the vehicle lighting unit main body 24. Furthermore, the supporting member 44 and the vertical guiding member 46 can be fixed together while the supporting member 44 (or both side faces 52*b*) is in surface contact with the vertical guiding member 46. Therefore, even if a heavy heat dissipation member 58 is fixed to the supporting member 44, the heavy heat dissipation member 58 can be firmly fixed.

In addition, the supporting member 44 and the vertical guiding member 46 can be fixed together while the supporting member 44 (or the both side faces 52*b*) is in surface contact with the vertical guiding member 46. Therefore, the heat generated in the light emitting device 10 can be surely dissipated.

The vehicle lighting unit with the above configuration according to the present exemplary embodiment can utilize a semiconductor laser light source as the excitation light source 14, thereby achieving a higher luminance light source than those using an LED light source.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle lighting unit comprising:

a light emitting device disposed below a predetermined light source position and having an excitation light source, a wavelength conversion member disposed at a position spaced away from and above the excitation light source, a condensing lens disposed between the excitation light source and the wavelength conversion member, and a holder configured to hold the excitation light source, the wavelength conversion member, and the condensing lens;

a supporting member configured to support the light emitting device so as to allow the light emitting device to move horizontally;

a first fixing member configured to fix the light emitting device and the supporting member together in a state where the wavelength conversion member is disposed on a vertical axis passing through the predetermined light source position;

a vertical guiding member in surface contact with the supporting member and having a vertical guiding face to allow the supporting member to vertically slide in a state where the supporting member is in surface contact with the vertical guiding member;

a stopper configured to restrict vertical movement of the supporting member with respect to the vertical guiding member, thereby positioning the wavelength conversion member in the predetermined light source position;

a second fixing member configured to fix the supporting member and the vertical guiding member together in a state where the light emitting device is in contact with the stopper and the supporting member is in surface contact with the vertical guiding face; and a vehicle lighting unit main body configured to project light emitted from the light emitting device disposed below the predetermined light source position in a forward direction.

2. The vehicle lighting unit according to claim 1, further comprising a heat dissipation member fixed to the supporting member and configured to dissipate heat generated from the excitation light source, and wherein the vehicle lighting unit main body includes a holding member having a through hole formed therein for allowing the holder to be fit to the through hole at its upper end.

3. The vehicle lighting unit according to claim 1, wherein the excitation light source is a semiconductor laser light source.

4. The vehicle lighting unit according to claim 2, wherein the excitation light source is a semiconductor laser light source.

5. The vehicle lighting unit according to claim 1, wherein the excitation light source is a light emitting diode.

6. The vehicle lighting unit according to claim 1, wherein the stopper includes a flange located on the light emitting device and a through hole located in the vehicle lighting unit main body.

7. The vehicle lighting unit according to claim 1, wherein the first fixing member and second fixing member are screws that mate with tapped holes.

8. The vehicle lighting unit according to claim 1, wherein the supporting member includes a supporting main body with tapped holes therein, and the light emitting device includes a flange with through holes therein that allow for screws to pass through such that the supporting member is configured to support the light emitting device so as to allow the light emitting device to move horizontally.

9. The vehicle lighting unit according to claim 1, wherein the vertical guiding member includes at least two substantially parallel rails spaced apart from each other a predetermined distance, and the supporting member includes a base portion with a center step portion configured to fit within and contact each of the two rails of the vertical guiding member.

10. A vehicle lighting unit, comprising:

a light emitting device including an excitation light source, a wavelength conversion member adjacent the excitation light source, and at least one holder configured to hold the excitation light source and the wavelength conversion member;

a positioning mechanism for positioning the light emitting device, the positioning mechanism including a supporting member configured to support the light emitting device, the supporting member including a base portion and a supporting main body, the positioning mechanism including at least one vertical guiding member located adjacent to the supporting member; and a main body that includes at least one reflector surface and an aperture into which the light emitting device is configured to be inserted, wherein the positioning mechanism is configured such that the light emitting device is slidable in a vertical direction between a first position in which the light emitting device is inserted in the aperture of the main body and a second position in which the light emitting device is spaced from the aperture of the main body, wherein the positioning mechanism includes at least two substantially parallel rails spaced apart from each other a predetermined distance, and further includes a center step portion located on the base portion and configured to fit within and contact each of the substantially parallel rails, wherein the light emitting device is attached to the base portion and is therefore vertically slidable with respect to the parallel rails and with respect to the main body.

11. The vehicle lighting unit according to claim 10, further comprising a heat dissipation member fixed to the positioning mechanism and configured to dissipate heat generated from the excitation light source.

12. The vehicle lighting unit according to claim 10, wherein the excitation light source is a semiconductor laser light source.

13. The vehicle lighting unit according to claim 10, wherein the excitation light source is a light emitting diode.

14. The vehicle lighting unit according to claim 10, wherein the light emitting device includes a flange located above the excitation light source, and the flange is configured to mate with the aperture located in the main body to stop vertical movement of the light emitting device with respect to the main body.

15. The vehicle lighting unit according to claim 10, further comprising a fixing member configured to lock the light emitting device with respect to the main body when the light emitting device is located in the aperture of the main body.

16. The vehicle lighting unit according to claim 10, wherein the main body is attached to the parallel rails and includes a projection lens.

* * * * *